US009961988B2

(12) United States Patent
Wedlock

(10) Patent No.: US 9,961,988 B2
(45) Date of Patent: May 8, 2018

(54) HAIR BRUSH WITH DUAL SHAPED HEAD FOR MANAGING BABY AND MATURE HAIR

(71) Applicant: Felisa Wedlock, Baltimore, MD (US)

(72) Inventor: Felisa Wedlock, Baltimore, MD (US)

( * ) Notice: Subject to any disclaimer, the term of this patent is extended or adjusted under 35 U.S.C. 154(b) by 0 days. days.

(21) Appl. No.: 15/219,050

(22) Filed: Jul. 25, 2016

(65) Prior Publication Data

US 2018/0020817 A1 Jan. 25, 2018

(51) Int. Cl.

| | |
|---|---|
| ***A46B 5/02*** | (2006.01) |
| ***A46B 9/06*** | (2006.01) |
| ***A46B 9/02*** | (2006.01) |
| ***A46B 5/00*** | (2006.01) |
| ***B25G 3/02*** | (2006.01) |
| ***B25G 1/10*** | (2006.01) |

(52) U.S. Cl.

CPC ..... *A46B 9/06* (2013.01); *A46B 5/0095* (2013.01); *A46B 5/02* (2013.01); *A46B 5/021* (2013.01); *A46B 9/023* (2013.01); *B25G 1/102* (2013.01); *B25G 3/02* (2013.01); *A46B 2200/104* (2013.01)

(58) Field of Classification Search

CPC ..... A46B 5/02; A46B 5/021; A46B 9/023; A46B 9/06; A46B 2200/104

See application file for complete search history.

(56) References Cited

U.S. PATENT DOCUMENTS

| | | | | | |
|---|---|---|---|---|---|
| 1,564,526 | A * | 12/1925 | Callais | A46B 9/06 | 15/159.1 |
| 3,707,739 | A * | 1/1973 | Hermann, Jr. | B25G 3/30 | 15/176.2 |
| 4,209,871 | A * | 7/1980 | Ernest | A46B 9/04 | 15/167.1 |
| 4,610,045 | A * | 9/1986 | Rauch | A46B 7/06 | 15/110 |
| D287,072 | S * | 12/1986 | Pfleger | D24/152 | |
| 2003/0084913 | A1* | 5/2003 | Gueret | A46B 3/18 | 132/218 |
| 2011/0219558 | A1* | 9/2011 | Vitt | A46B 3/22 | 15/167.1 |

* cited by examiner

*Primary Examiner* — Randall Chin

(57) ABSTRACT

The invention relates to a hair brush having a dual shaped head for effectively managing baby and mature hair for the purpose of grooming and styling hair. The hair brush includes a dual shaped head having a first section with a first shape and a second section with a second shape. The first section with the first shape includes a cluster of bristles of a first type and the second section with the second shape includes a cluster of bristles of a second type. The cluster of bristles of the first type positioned adjacent to the cluster of bristles of the second type. The dual shaped head further includes a rotatable base that allows the sections to be positioned according to grooming and styling needs. The hair brush further includes a handle with a hollow cavity for storing hair products.

12 Claims, 1 Drawing Sheet

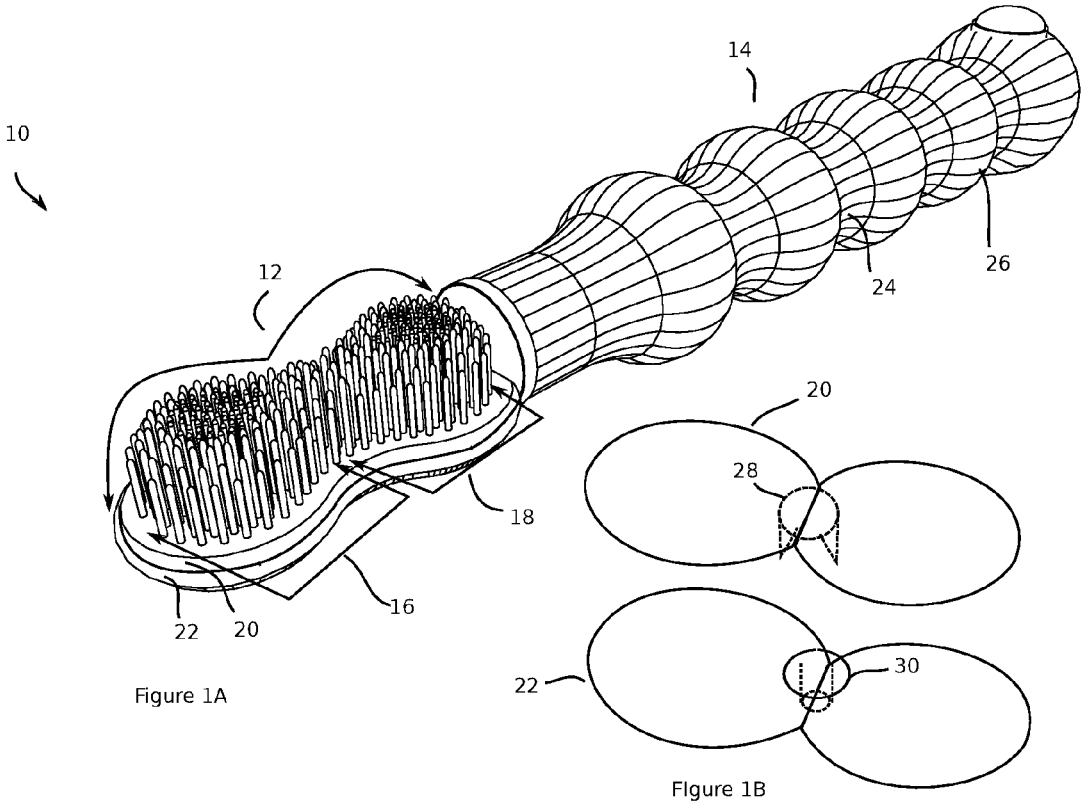
Figure 1A
Figure 1B
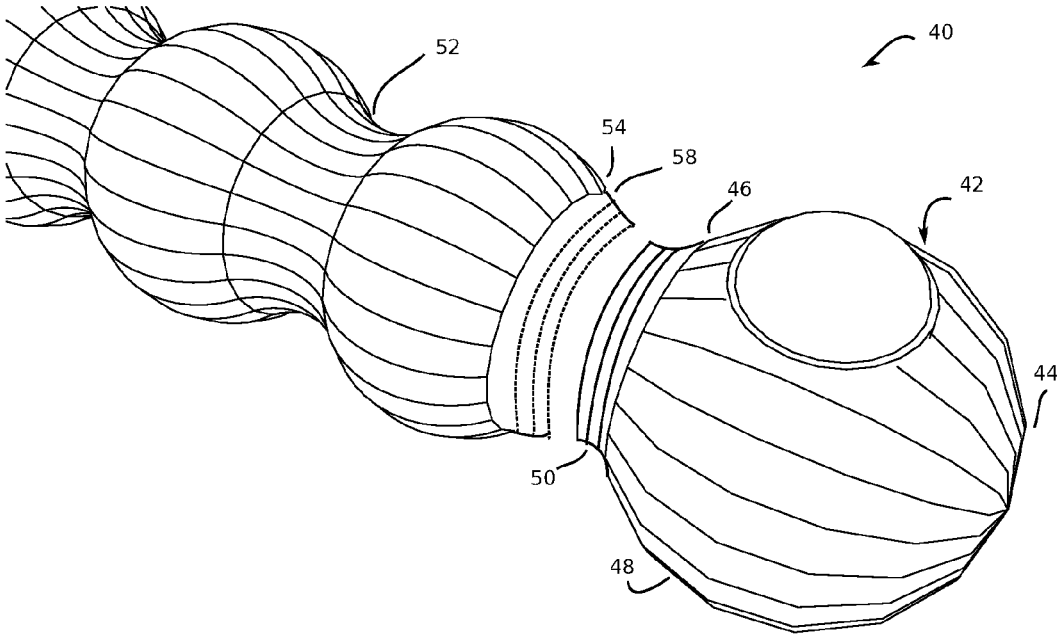
Figure 2

HAIR BRUSH WITH DUAL SHAPED HEAD FOR MANAGING BABY AND MATURE HAIR

TECHNICAL FIELD

The present invention relates generally to a hair brush. In particular, it relates to a hair brush having a dual shaped head with each head section having a cluster of bristles suitable for brushing different types of hair.

BACKGROUND

For most people, especially celebrities and professionals, having properly groomed and styled hair is very important in personal and professional life. A problem for most people is how to tame and style baby hair, i.e. the hair that defines the hairline edge along a person's scalp, in addition to taming and styling more mature hair around the baby that in combination with baby hair provides for a unique groomed and styled look when properly managed. In the current state of the art, however, the tools necessary to manage the baby hair and the mature hair are not readily available or are limited. It is not uncommon to see people managing this part of their hair using a tooth brush; which for most people, this practice is not desirable, especially in public. Although there are styling products that can help assist in managing and styling baby hair and the more mature hair, there are no styling hairbrushes designed specifically to address this need.

As such, there is a need for a hairbrush that provides a person with the ability to style their baby hair as well as style their more mature hair.

SUMMARY

The present invention is directed to a hair brush with a dual shaped head for effectively managing baby and mature hair for the purpose of grooming and styling hair.

According to this invention, a hair brush includes a dual shaped head having a first section with a first shape and a second section with a second shape. The first section with the first shape having a cluster of bristles of a first type and the second section with the second shape having a cluster of bristles of a second type. The cluster of bristles of the first type positioned adjacent to the cluster of bristles of the second type.

According to this invention, the dual shaped head further includes a base bottom portion having a male insert and a base top portion having a female receptacle for mating with the male insert. The base top portion when mated with the base bottom portion is rotatable about the base bottom portion allowing the first section and second section of the dual shaped head to be positioned according to grooming and styling needs.

According to this invention, the hair brush further includes an elongated handle that comprises a bottom portion coupled to the dual shaped head and an upstanding side wall portion surrounding and continuing the bottom portion to form a cavity. Formed along a wall of the cavity at an opposite end of the bottom portion is a female receptacle. The hair brush further includes a cap with a male insert adapted to mate with the female receptacle. The cavity, e.g., may be used to store hair products.

BRIEF DESCRIPTION OF THE DRAWINGS

FIG. 1A is a perspective view of a hair brush with a dual shaped head and handle.

FIG. 1B is a side view of base bottom portion and base top base portion of the dual shaped head with male insert and female receptacle.

FIG. 2 is a perspective view of the handle with a handle base and handle cap.

DETAILED DESCRIPTION

The present invention is directed to a hair brush 10 which provides an effective and efficient technique for managing baby and mature hair.

Referring to FIGS. 1A and 1B, a hair brush is illustrated and denoted generally as 10 and includes a dual shaped head 12 and a handle 14. The dual shaped head 12 further comprises a first section 16 along the surface of the dual shaped head with a rounded shape and having a cluster of bristles of a first type and a second section 18 along the surface of the dual shaped head with a rounded shape and having a cluster of bristles of a second type. Although, it should be understood the shape can be of any dimension. The function of the shape is to highlight the different sections that have different uses.

The dual shaped head may further include a base top portion 20 and a base bottom portion 22. The base top portion 20 includes upon the top surface the first and second section 16,18 with bristles. The base top portion 20 and the base bottom portion 22 can be coupled together and allow the top portion 20 to rotate about the bottom portion 22.

The handle 14 may be an elongated handle of dimensions suitable for a user to easily grasp. The handle may comprise sections 24,26 marked by varying width and length. These sections provide for a user's hand to grip the handle in a more ergonomic way to better facilitate the user managing the hair brush and doing so in a more comfortable manner.

The dual shaped head 12 is formed into a shape of a figure eight or infinity symbol. The shape, although not necessarily required to be an infinity shape, facilitates the user in understanding that the sections are for use with different parts of the hair when grooming; i.e., one section being better suited for managing baby hair along the scalp and the other for managing more mature hair leading away from the scalp. In addition, the bristles on the first section 16, e.g., may be soft or fine. This section being more suitable to manage baby hair. The bristles of the second section 18 may be more coarse and better suited to manage more mature coarse hair. Although FIG. 1A illustrates the shape of the head 12 being a figure eight or infinity symbol, the first and second section 16,18 may be of other shapes and forms and each section may be unique in shape form.

With reference now to FIG. 1B, a top view of the base top portion 20 and base bottom portion 22 is illustrated. Base top portion 20 includes a female receptacle clip 28. The female receptacle clip 28 may be, e.g., a fastener made of plastic injection molding that includes protruding v-shaped clips for receiving a male member and coupling thereto. The base bottom portion 22 includes a male insert 30 with a protruding base and base top that when mated with the v-shaped clips allows the base top portion 20 and base bottom portion 22 to couple and, furthermore, allow the base top portion 20 to rotate about the base bottom portion 22. Although, it should be understood the male inserts 30 may be formed on base top portion 20 and the female clips 28 may be formed on base bottom portion 22.

Referring now to FIG. 2, illustrated is an alternative embodiment of handle 14 denoted generally as 40. Handle 40 includes a cap 42 comprising a top portion 44 and a bottom portion 46 on the opposite end and an upstanding side wall portion 48 surrounding and continuing the bottom and base portion. The bottom portion 46 includes a male insert 50 formed along the bottom portion 46. E.g., the male insert 50 may be a threaded member of the cap formed along the base edge of the bottom portion.

Handle 40 further includes base handle 52 that includes a bottom portion coupled with the dual headed brush and a sidewall portion that surrounds and continues the base portion to form a cavity, as to that described in FIG. 1. Base handle 52 further includes a top end 54 and formed thereon is a female insert 58. E.g., the female insert 58 may be a threaded member for receiving the male insert 50 of the cap 42. The cap being able to be removed from the base handle allows a user to store product in the cavity.

Thus, While there have been shown and described and pointed out fundamental novel features of the invention as applied to a preferred embodiment thereof, it will be under stood that various omissions and substitutions and changes in the form and details of the apparatus illustrated, and its operation, may be made by those skilled in the art Without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention claimed is:

1. A hair brush comprising:

a dual shaped head having a first section with a first shape and having a cluster of bristles of a first type and a second section with a second shape having a cluster of bristles of a second type with the cluster of bristles of the first type positioned adjacent to the cluster of bristles of the second type; and an elongated handle connected to the dual shaped head; wherein the dual shaped head further comprises: a base bottom portion having a male insert; a base top portion having a female receptacle for mating with the male insert; and the base top portion when mated with the base bottom portion is rotatable about the base bottom portion.

2. The hair brush of claim 1 wherein the first section and second section are of the same shape.

3. The hair brush of claim 1 wherein the bristles are made of nylon.

4. The hair brush of claim 3 wherein the bristles of the first type are of a soft type.

5. The hair brush of claim 3 wherein the bristles of the second type are of a coarse type.

6. The hair brush of claim 1 wherein the elongated handle comprises sections marked by alternating sections each having varying width and length.

7. A hair brush comprising:

a dual shaped head having a first section with a first shape and having a cluster of bristles of a first type and a second section with a second shape having a cluster of bristles of a second type with the cluster of bristles of the first type positioned adjacent to the cluster of bristles of the second type; and an elongated handle; wherein the elongated handle further comprises:

a base that comprises a bottom portion coupled to the dual shaped head and an upstanding side wall portion surrounding and continuing the bottom portion to form a cavity with a female receptacle formed along the wall of the cavity at the opposite end of the bottom portion; and a cap having a male insert adapted to mate with the female receptacle.

8. The hair brush of claim 7 wherein the first section and second section are of the same shape.

9. The hair brush of claim 7 wherein the bristles are made of nylon.

10. The hair brush of claim 9 wherein the bristles of the first type are of a soft type.

11. The hair brush of claim 9 wherein the bristles of the second type are of a coarse type.

12. The hair brush of claim 7 wherein the elongated handle comprises sections marked by alternating sections each having varying width and length.

* * * * *